US008093824B2

(12) United States Patent
Lee et al.

(10) Patent No.: US 8,093,824 B2
(45) Date of Patent: Jan. 10, 2012

(54) BACKLIGHT DRIVING SYSTEM

(75) Inventors: Yong-Long Lee, Jhongli (TW); Chin-Po Cheng, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 454 days.

(21) Appl. No.: 12/483,233

(22) Filed: Jun. 11, 2009

(65) Prior Publication Data

US 2010/0181920 A1 Jul. 22, 2010

(30) Foreign Application Priority Data

Jan. 16, 2009 (CN) ..... 2009 2 0129516

(51) Int. Cl.
*H05B 37/00* (2006.01)

(52) U.S. Cl. ..... 315/276; 315/278; 315/307; 315/308

(58) Field of Classification Search ..... 315/276, 315/277, 307, 308, 291, 278, 279, 282, 219, 315/220

See application file for complete search history.

(56) References Cited

U.S. PATENT DOCUMENTS 6,459,216 B1 * 10/2002 Tsai ..... 315/294
7,719,211 B2 * 5/2010 Kuo et al. ..... 315/308
7,764,024 B2 * 7/2010 Cheng et al. ..... 315/291

FOREIGN PATENT DOCUMENTS

CN 1254155 C 4/2006
CN 1770946 A 5/2006

* cited by examiner

*Primary Examiner* — David Hung Vu
(74) *Attorney, Agent, or Firm* — Altis Law Group, Inc.

(57) ABSTRACT

A backlight driving system comprises an inverter module, a current balance module, a feedback module and an open-lamp protection detection module. The inverter module provides electrical signals to a plurality of lamps. The current balance module balances currents flowing through the plurality of lamps. The feedback module detects the current of the backlight and generates a feedback signal to the invert module accordingly. The open-lamp protection detection module detects voltage variations of the feedback transformer and generates a detection signal to the inverter module accordingly. The inverter module regulates the currents flowing through the plurality of lamps according to the feedback signal and determines one or more of the plurality of lamps are faulty according to the detection signal generated by the open-lamp protection detection module, and stops providing the electrical signals to the plurality of lamps.

11 Claims, 3 Drawing Sheets

BACKLIGHT DRIVING SYSTEM

BACKGROUND

1. Technical Field

Embodiments of the present disclosure relates to backlight driving systems, and particularly to a backlight driving system to drive a plurality of lamps.

2. Description of Related Art

Discharge lamps, such as cold cathode fluorescent lamps (CCFLs), are used as backlights for liquid crystal display (LCD) panels. Normally, the CCFLs are driven by electrical signals provided by inverter circuits.

In a large-size LCD panel, such as an LCD TV, two or more lamps are employed to provide sufficient brightness to meet practical requirements. However, currents flowing through the lamps may be unbalanced due to different characteristics of the lamps. Thus, brightness of the large-size LCD panel may not be uniform.

Additionally, any faults or abnormalities in the lamps will affect the entire LCD panel. For example, as lamps age, uniformity of current flow or other electrical characteristics may deteriorate. As more lamps are employed in a LCD panel, faults or abnormalities in any one lamp may be difficult to detect.

BRIEF DESCRIPTION OF THE DRAWINGS

Many aspects of the embodiments can be better understood with references to the following drawings, wherein like numerals depict like parts, and wherein.

DETAILED DESCRIPTION

Figure 1:
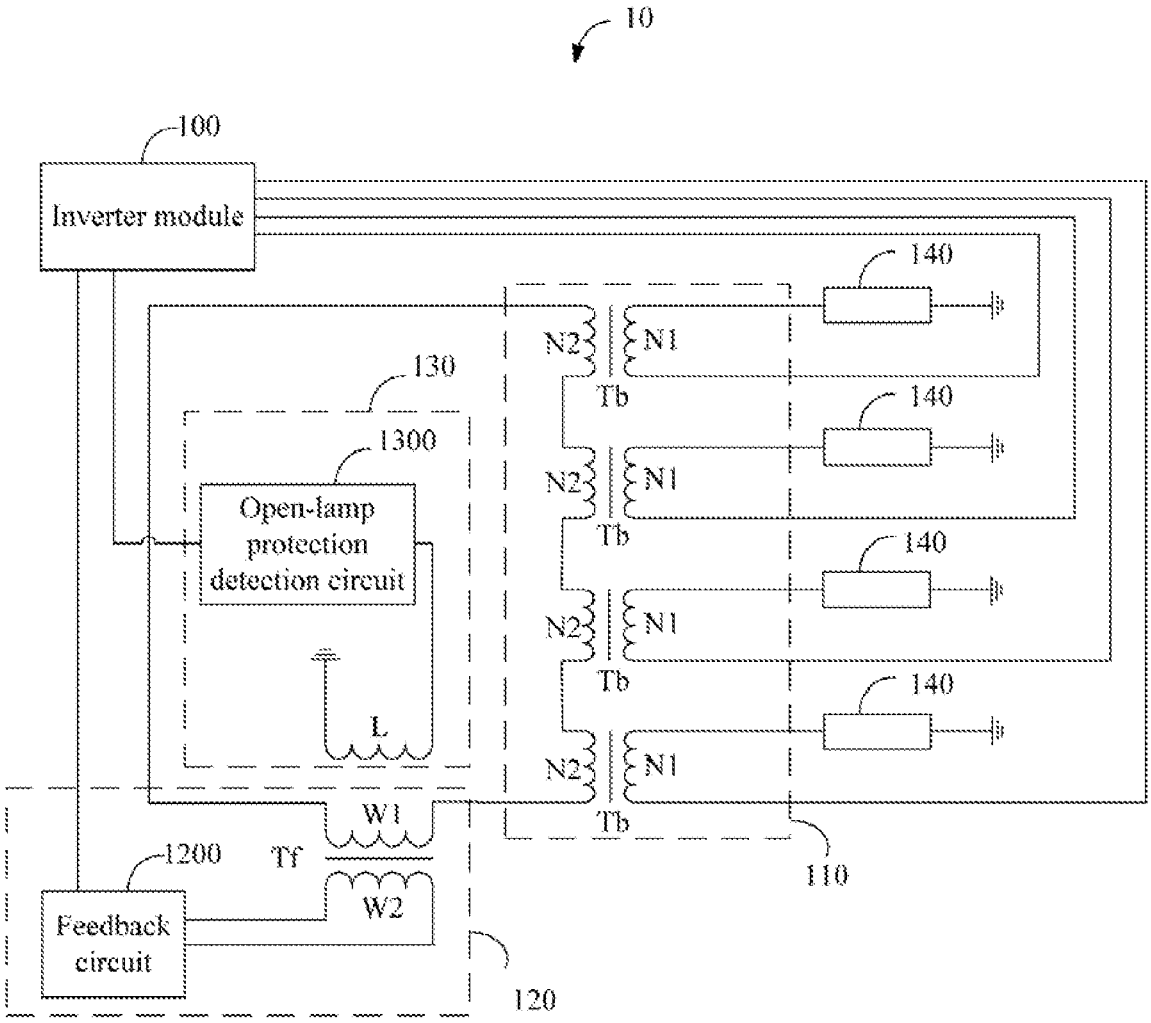
FIG. 1 is a circuit diagram of a backlight driving system of a first embodiment of the present disclosure.

Referring to FIG. 1, a circuit diagram of a backlight driving system 10 of a first embodiment of the present disclosure is shown. The backlight driving system 10 drives a plurality of lamps 140, and comprises an inverter module 100, a current balance module 110, a feedback module 120 and an open-lamp detection module 130. The inverter module 100 provides electrical signals to drive the plurality of lamps 140. In one embodiment, the inverter module 100 comprises a plurality of commonly used circuits, such as a switch circuit, a transformer circuit, and a control circuit. The electrical signals may be sine-wave signals and comprise high positive voltage signals and high negative voltage signals. Voltage phase differences between the high positive voltage signals and the high negative voltage signals are approximately 180°.

The current balance module 110 comprises a plurality of first balance transformers Tb. In one embodiment, each of the plurality of first balance transformers Tb comprises a high voltage winding N1 and a low voltage winding N2, where both the high voltage winding N1 and the low voltage winding N2 comprise a first end and a second end. The high voltage winding N1 of each first balance transformer Tb is connected between one end of a lamp 140 and the inverter circuit 100. The low voltage windings N2 of the plurality of first balance transformers Tb are connected in series. The second end of the low voltage winding N2 of a first one of the plurality of first balance transformers Tb is connected to the first end of the low voltage winding N2 of a second one of the plurality of first balance transformers Tb. The second end of the low voltage winding N2 of the second one of the plurality of first balance transformers Tb is connected to the first end of the low voltage winding N2 of a third one of the plurality of first balance transformers Tb, and so on through to the second end of the low voltage winding N2 of a last but one of the plurality of first balance transformers Tb is connected to the first end of the low voltage winding N2 of a last one of the plurality of first balance transformers Tb. Because the low voltage windings N2 of the plurality of first balance transformers Tb are connected in series, currents flowing through the low voltage windings N2 of the plurality of first balance transformers Tb are about equal. If the plurality of first balance transformers Tb are the same, the currents flowing through the high voltage windings N1 of the plurality of first balance transformers Tb are also about equal. Thus, the currents flowing through the plurality of lamps 140 are balanced by the current balance module 110.

In one embodiment, one end of the plurality of lamps 140 receives the electrical signals, and the other end thereof is grounded. In alternative embodiments, one end of the plurality of lamps 140 receives the high positive voltage signals, and the other end thereof receives the negative voltage signals.

The feedback module 120 comprises a feedback transformer Tf and a feedback circuit 1200. In one embodiment, the feedback transformer Tf comprises a primary winding W1 and a secondary winding W2. The primary winding W1 of the feedback transformer Tf is connected in series with the low voltage windings N2 of the plurality of first balance transformers Tb to detect the currents flowing through the plurality of lamps 140 and to generate a feedback signal to the inverter module 100 accordingly. Namely, the primary winding of the feedback transformer Tf comprises a first end connected to the first end of the low voltage winding N2 of the first one of the plurality of first balance transformers Tb, and a second end connected to the second end of the low voltage winding N2 of the last one of the plurality of first balance transformers Tb, forming a closed loop. The secondary winding W2 of the feedback transformers is connected to the feedback circuit 1200. The feedback circuit 1200 receives voltage variations of the feedback transformer Tf that indicate current variations of the plurality of lamps 140, and generates a feedback signal accordingly, to the inverter module 100, to regulate the currents flowing through the plurality of lamps 140.

The open-lamp protection module 130 comprises a detection coil L and an open-lamp protection detection circuit 1300. The detection coil L is wrapped around the feedback transformer Tf with one end grounded and the other end connected to the open-lamp protection detection circuit 1300. The detection coil L detects the voltage variations of the feedback transformer Tf consistently, and provides feedback to the open-lamp protection detection circuit 1300. Then, the open-lamp protection detection circuit 1300 generates the detection signal (for example, a voltage signal) accordingly to the inverter circuit 100. The inverter module 100 determines one or more of the plurality of lamps 140 are faulty according to the detection signal, and stops providing the electrical signals to the plurality of lamps 140.

Figure 2:
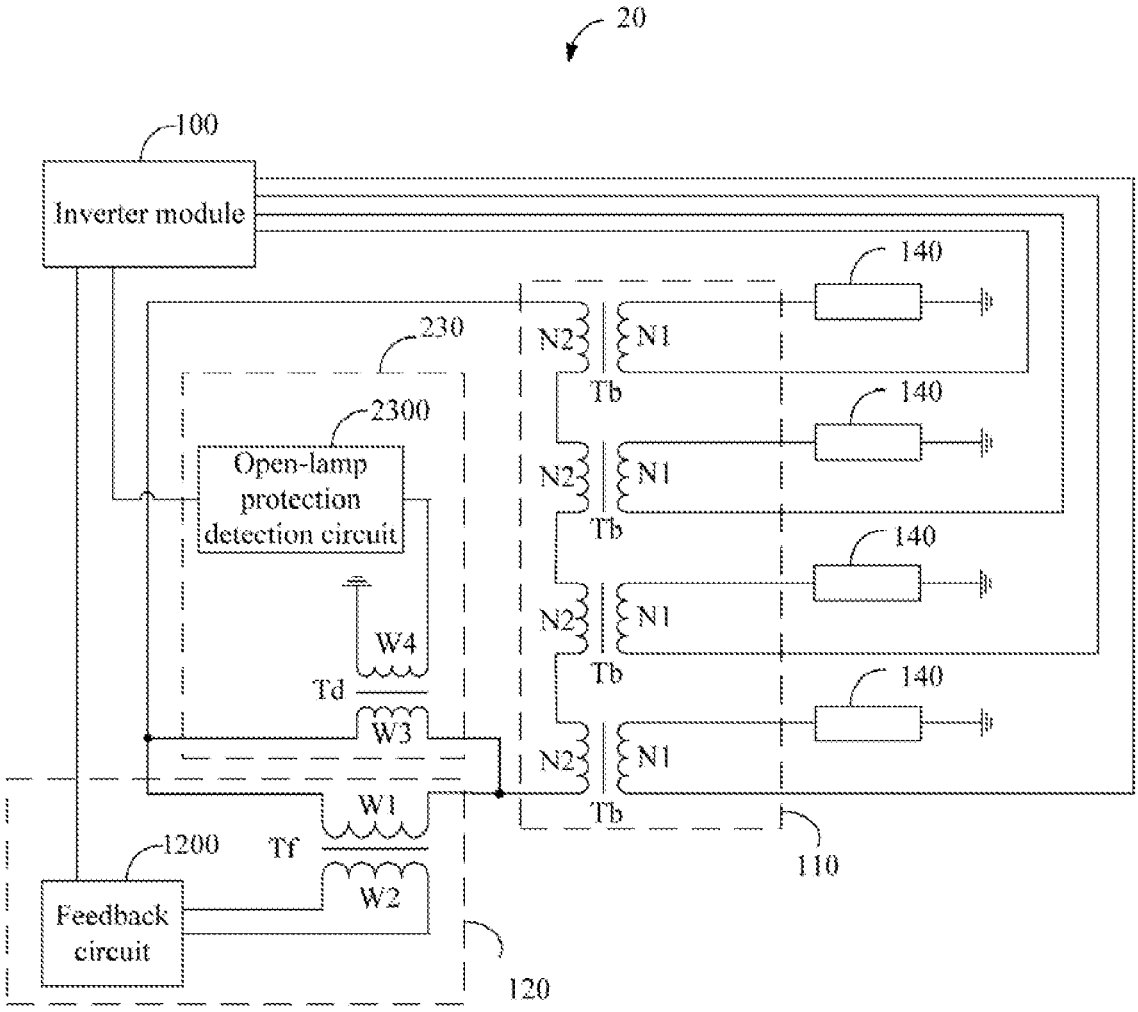
FIG. 2 is a circuit diagram of a backlight driving system of a second embodiment of the present disclosure.

FIG. 2 is a circuit diagram of a backlight driving system 20 of a second embodiment of the present disclosure, differing from the backlight driving system 10 in that an open-lamp protection module 230 comprises a detection transformer Td and an open-lamp protection detection circuit 2300. In the embodiment, the detection transformer Td comprises a primary winding W3 and a secondary winding W4. The primary winding W3 of the detection transformer Td is connected in parallel with the primary winding W1 of the feedback transformer Tf. Namely, the primary winding W3 comprises a first end connected to the first end of the low voltage winding N2 of the first one of the balance transformers Tb, and a second end connected to the second end of the low voltage winding N2 of the last one of the plurality of first balance transformers Tb, which forms a closed loop. The secondary winding W4 of the detection transformer Td comprises a first end grounded and a second end connected to the open-lamp protection detection circuit 2300.

Figure 3:
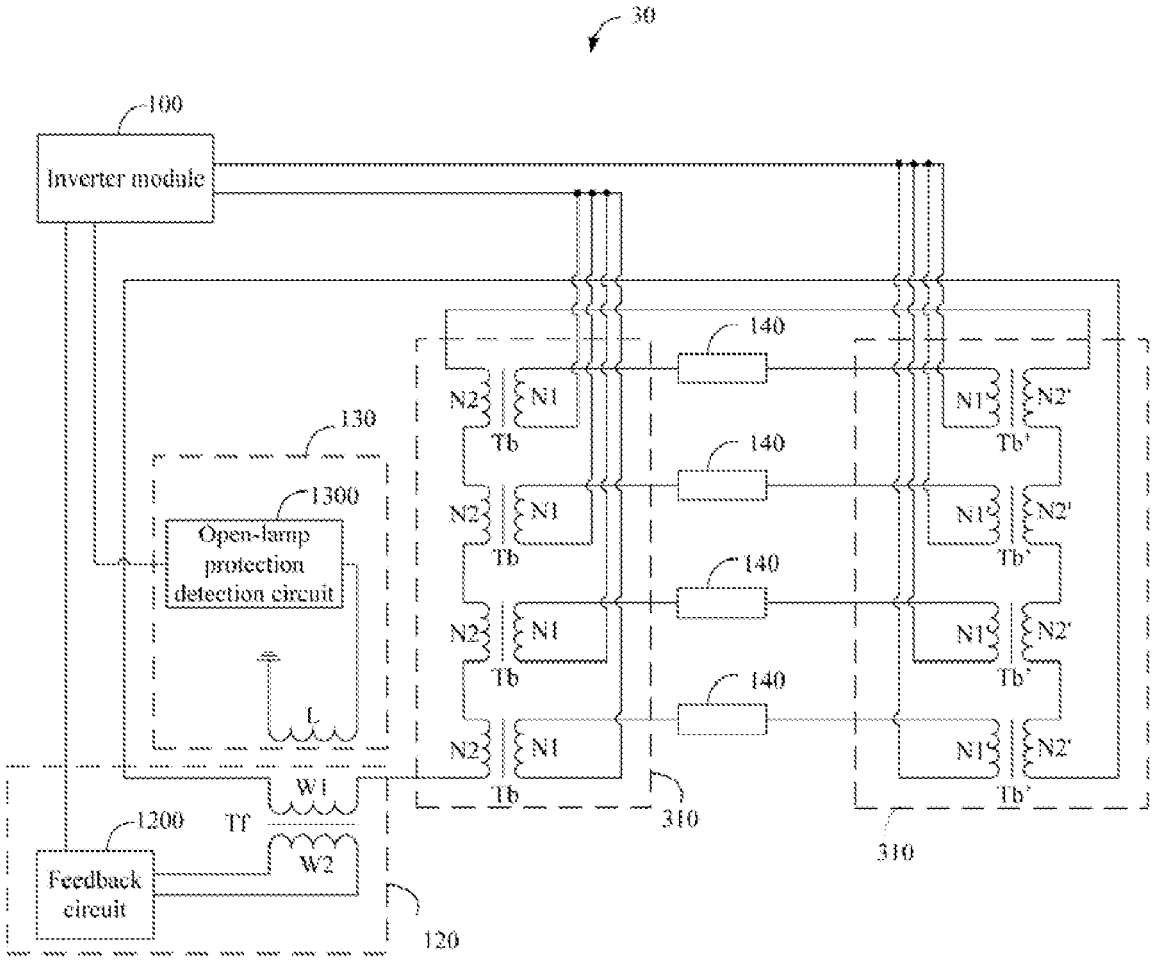
FIG. 3 is a circuit diagram of a backlight driving system of a third embodiment of the present disclosure.

FIG. 3 is a circuit diagram of a backlight driving system 30 of a third embodiment of the present disclosure, differing from the backlight driving system 20 of FIG. 2 in that a current balance module 310 comprises a plurality of first balance transformers Tb and a plurality of second balance transformers Tb'. The configurations of the plurality of first balance transformers Tb of the current balance module 310 are the same with these of the current balance circuit 110 of FIG. 1.

Each of the plurality of second balance transformers Tb' comprises a high voltage winding N1' and a low voltage winding N2', and both the high voltage winding N1' and the low voltage winding N2' comprise a first end and a second end. The high voltage winding N1' of each second balance transformers Tb' is connected between the other end of a lamp 140 and the inverter circuit 100. The low voltage windings N2' of the plurality of second balance transformers Tb' are connected in series with those of the plurality of first balance transformers Tb. The second end of the low voltage winding N2' of a first one of the plurality of second balance transformers Tb' is connected to the first end of the low voltage winding N2' of a second one of the plurality of second balance transformers Tb'. The second end of the low voltage winding N2' of the second one of the plurality of second balance transformers Tb' is connected to the first end of the low voltage winding N2 of a third one of the plurality of second balance transformers Tb', so on through to the second end of the low voltage winding N2' of the last but one of the plurality of first balance transformers Tb' is connected to the first end of the low voltage winding N2' of a last one of the plurality of first balance transformers Tb'. The first end of the low voltage winding N2' of the first one of the plurality of second balance transformers Tb' is connected to the first end of the low voltage winding N2 of the first one of the plurality of first balance transformers Tb. The low voltage windings N2' of the plurality of second balance transformers Tb', the low voltage winding N2 of the first balance Tb and the primary winding W1 of the feedback transformer Tf are connected in series to form a closed loop collectively. The second end of the low voltage winding N2' of the last one of the plurality of second balance transformers Tb' is connected to the first end of the primary winding W1 of the feedback transformer Tf. The second end of the primary winding W1 of the feedback transformer Tf is connected to the second end of the low voltage winding N2 of the last one of the first balance transformer Tb. In one embodiment, one end of the plurality of lamps 140 receives the high positive voltage signal and the other end thereof receives the high negative voltage signal.

It should be noted that the current balance circuit 310 as shown in FIG. 3 can be employed instead of the current balance module 110 of FIG. 2.

It is apparent that the present disclosure provides a backlight driving system operable to balance currents flowing through the plurality of lamps 140, and to determine if one or more of the plurality of lamps 140 are faulty by detecting the current variations of the plurality of lamps 140, and to stop to providing the electrical signals to the plurality of lamps 140.

It is believed that the present embodiments and their advantages will be understood from the foregoing description, and it will be apparent that various modifications, alterations and changes may be made thereto without departing from the spirit and scope of the invention or sacrificing all of its material advantages, the examples hereinbefore described merely being preferred or exemplary embodiments of the invention.

What is claimed is:

1. A backlight driving system, comprising:

an inverter module to provide electrical signals to drive a plurality of lamps;

a current balance module comprising a plurality of first balance transformers, each comprising a low voltage winding and a high voltage winding connected between one end of one of the plurality of lamps and the inverter module, wherein the low voltage windings of the plurality of first balance transformers are connected in series to balance currents flowing through the plurality of lamps;

a feedback module comprising a feedback circuit and a feedback transformer comprising a primary winding, wherein the primary winding of the feedback transformer is connected in series with the low voltage windings of the plurality of first balance transformers to detect the currents flowing through the plurality of lamps and a secondary winding connected to the feedback circuit to generate a feedback signal to the inverter module accordingly; and an open-lamp protection detection module comprising an open-lamp protection detection circuit and a detection coil wrapped around the feedback transformer to detect voltage variations of the feedback transformer;

wherein the open-lamp protection detection module generates a detection signal when the open-lamp protection detection module detects the voltage variations and transmits the detection signal to the inverter module.

2. The backlight driving system as claimed in claim 1, wherein the primary winding of the feedback transformer and the low voltage windings of the plurality of first balance transformers form a closed loop.

3. The backlight driving system as claimed in claim 1, wherein one end of the detection coil is grounded and the other end of the detection coil is connected to the open-lamp protection detection circuit.

4. The backlight driving system as claimed in claim 1, wherein the inverter module is operable to determine one or more of the plurality of lamps are faulty according to the detection signal generated by the open-lamp protection detection module, and to stop providing the electrical signals to the plurality of lamps.

5. The backlight driving system as claimed in claim 1, wherein the current balance module comprises a plurality of second balance transformers each comprising a high voltage winding and a low voltage winding, wherein the high voltage winding of each second balance transformer connected between the other end of one of the plurality of lamps and the inverter module, the low voltage windings of the plurality of second balance transformers are connected in series with low voltage windings of the plurality of first balance transformers.

6. The backlight driving system as claimed in claim 5, wherein the low voltage windings of the plurality of first balance transformers, the low voltage windings of the plurality of second balance transformers, and the primary winding of the feedback transformer are connected in series to form a closed loop collectively.

7. A backlight driving system, comprising:

an inverter module to provide electrical signals to drive a plurality of lamps;

a current balance module comprising a plurality of first balance transformers, each comprising a low voltage winding and a high voltage winding connected between one end of one of the plurality of lamps and the inverter module, wherein the low voltage windings of the plurality of first balance transformers are connected in series to balance currents flowing through the plurality of lamps;

a feedback module comprising a feedback circuit and a feedback transformer comprising a primary winding, wherein the primary winding of the feedback transformer is connected in series with the low voltage windings of the plurality of first balance transformers to detect the currents flowing through the plurality of lamps and a secondary winding connected to the feedback circuit to generate a feedback signal to the inverter module accordingly; and an open-lamp protection detection module comprising an open-lamp protection detection circuit and a detection transformer comprising a primary winding, wherein the primary winding of the detection transformer is connected in parallel with the high voltage winding of the feedback transformer to detect voltage variations of the feedback transformer;

wherein the open-lamp protection detection module generates a detection signal when the open-lamp protection detection module detects the voltage variations and transmit the detection signal to the inverter module.

8. The backlight driving system as claimed in claim 7, wherein the primary winding of the feedback transformer and the low voltage windings of the plurality of first balance transformers form a closed loop.

9. The backlight driving system as claimed in claim 7, wherein the inverter module is operable to determine one or more of the plurality of lamps are faulty according to the detection signal generated by the open-lamp protection detection module, and to stop providing the electrical signals to the plurality of lamps.

10. The backlight driving system as claimed in claim 7, wherein the current balance module comprises a plurality of second balance transformers each comprising a low voltage winding and a high voltage winding connected between the other end of one of the plurality of lamps and the inverter module, the low voltage windings of the plurality of second balance transformers are connected in series with the low voltage windings of the plurality of first balance transformers.

11. The backlight driving system as claimed in claim 10, wherein the low voltage windings of the plurality of first balance transformers, the low voltage windings of the plurality of second balance transformers, and the high voltage winding of the feedback transformer are connected in series to form a closed loop collectively.

* * * * *